United States Patent [19]

Weber

[11] 4,294,425

[45] Oct. 13, 1981

[54] OVERHEAD BOOKHOLDER

[76] Inventor: Paul J. Weber, 22 Seneca Rd., Fort Lauderdale, Fla. 33308

[21] Appl. No.: 82,862

[22] Filed: Oct. 9, 1979

[51] Int. Cl.[3] ..... A47B 23/00

[52] U.S. Cl. ..... 248/445; 248/328; 248/451

[58] Field of Search ..... 248/327, 328, 445, 451, 248/454

[56] References Cited

U.S. PATENT DOCUMENTS

| | | | |
|---|---|---|---|
| 579,992 | 4/1897 | Leiber | 248/451 |
| 1,692,337 | 11/1928 | Forbes | 248/445 |
| 2,015,280 | 9/1935 | Morishita | 248/451 |
| 2,673,705 | 3/1954 | Buckley | 248/317 |
| 3,901,165 | 8/1975 | Schlesinger | 248/328 |

FOREIGN PATENT DOCUMENTS

| | | | |
|---|---|---|---|
| 465044 | 5/1950 | Canada | 248/445 |

*Primary Examiner*—William H. Schultz

*Attorney, Agent, or Firm*—Oltman and Flynn

[57] ABSTRACT

The present apparatus suspends a book above the reader from an overhead support. It includes a suspension line hanging down from two support attachments above. Suspended from the middle of the line is an assembly of a book tie rod which holds the book along its spine and a suspension bar extending from side to side behind the cover of the book. An apertured control tube couples the book tie rod to the suspension bar. Page retainers are carried by the suspension bar to engage the open pages of the book. A pitch line extends down to the suspension bar at one side of the book from a pitch bar which engages the opposite sides of the hang line a short distance above the suspension bar and tie rod.

13 Claims, 4 Drawing Figures

OVERHEAD BOOKHOLDER

SUMMARY OF THE INVENTION

This invention relates to an apparatus for suspending an open book or magazine above a person lying on his or her back.

Various bookholders have been proposed heretofore for use by a person in bed. Examples of such prior arrangements are shown in the following U.S. Pat. Nos. Morgan 1,719,190, Singleton et al 3,514,066, Torme 3,889,914, and Wiersma 4,021,013. In each of these devices the book is held upright or at a slight inclination to the vertical, so as to be suitable for a person sitting up in bed but not while lying flat on his or her back.

Other bookholders for use on a table, desk or other horizontal support surface are disclosed in the following U.S. Pat. Nos. Lewis 3,674,231, and Graham 4,015,813.

The present invention is directed to a bookholder for use by a person lying horizontal, or substantially so, on his or her back. It is particularly advantageous for use by patients in hospitals, convalescent centers or nursing homes who cannot, or do not wish to, sit up in bed while reading. However, it is to be understood that it may be used by anyone who prefers to read lying down.

A principal object of this invention is to provide a novel and improved apparatus for holding a book open and in a position to be read by a person lying on his or her back.

Another object of this invention is to provide such an apparatus which enables an open book to be suspended substantially horizontal above the reader, or at a selected inclination from the top of the page to the bottom to suit the reader's preference.

Another object of this invention is to provide a novel overhead bookholder which enables quick and easy insertion or removal of a book and also quick and easy turning of the pages.

Another object of this invention is to provide such a bookholder which is readily adjustable to accommodate books of different sizes.

Further objects and advantages of this invention will be apparent from the following detailed description of a presently-preferred embodiment thereof, which is shown in the accompanying drawings.

DETAILED DESCRIPTION

Before explaining the disclosed embodiment of the present invention in detail, it is to be understood that the invention is not limited in its application to the details of the particular arrangement shown since the invention is capable of other embodiments. Also the terminology used herein is for the purpose of description and not of limitation.

Figure 1:
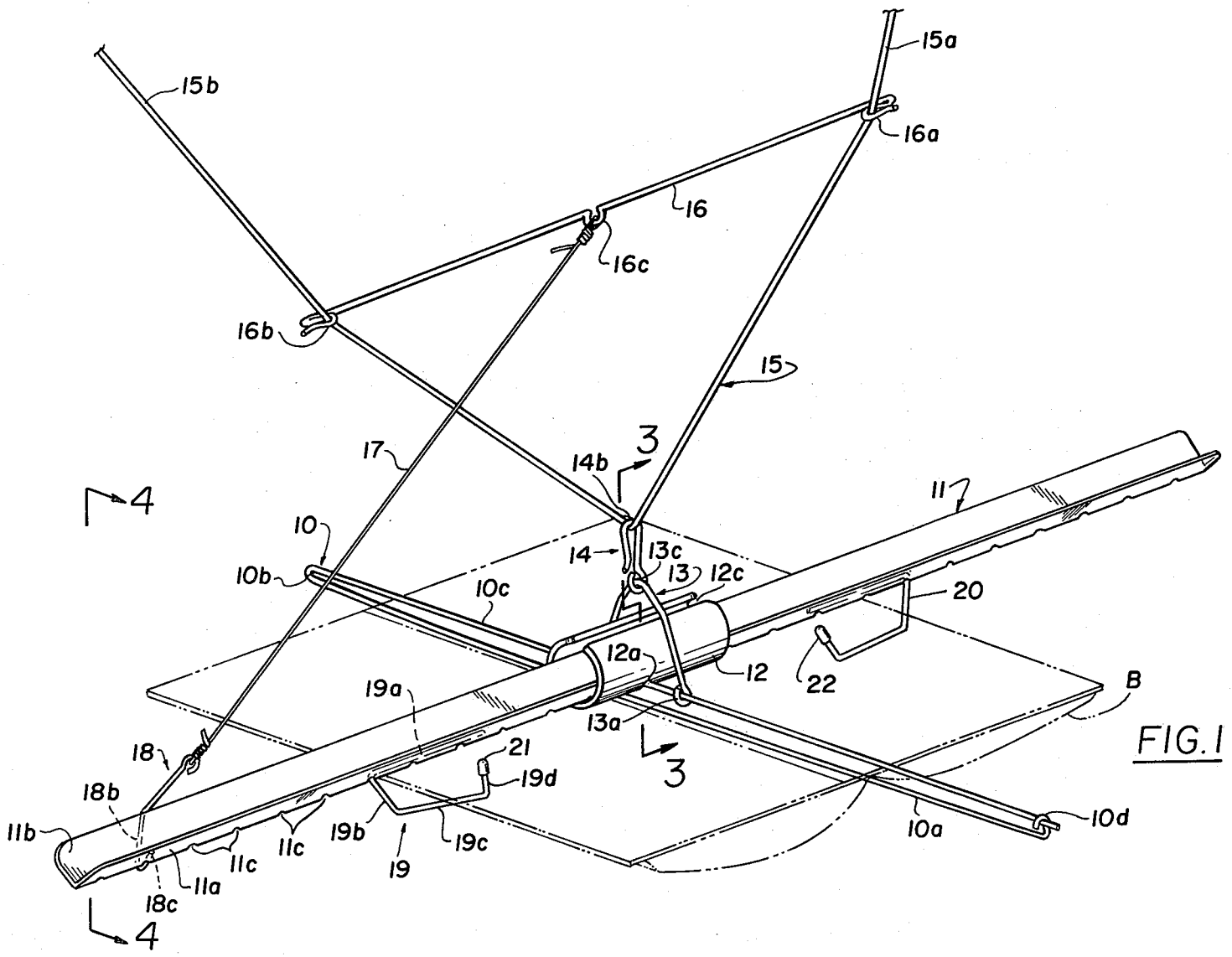
FIG. 1 is a perspective view of the present bookholder, with an open book shown in phantom in the holder.
Figure 2:
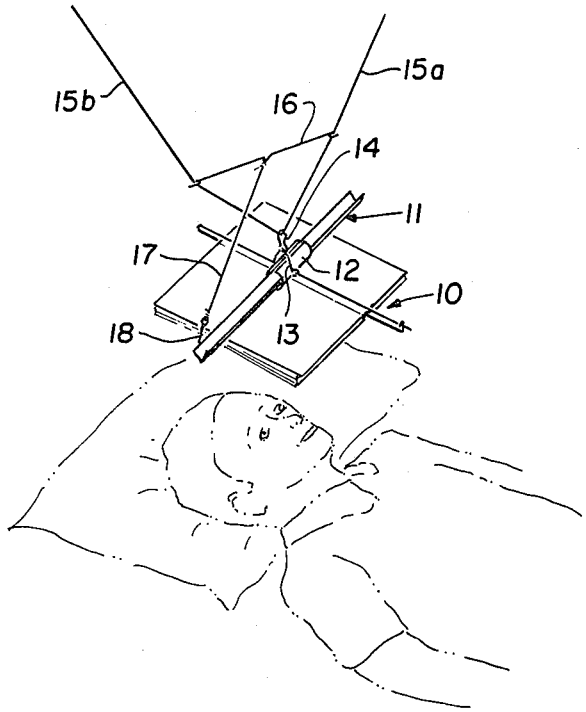
FIG. 2 is a perspective view showing the bookholder holding the book above a person lying down.

Referring to FIG. 1, the illustrated embodiment of the present bookholder comprises the following components:

(1) a book tie rod 10 which extends along the "gutter" between the open pages of the book and along the spine of the book;

(2) a suspension bar 11 which extends from side to side across the cover of the book perpendicular to the book tie rod;

(3) a control tube 12 which holds the tie rod 10 assembled to bar 11 at the middle of the latter;

(4) a suspension wire 13 for the book tie rod 10 which straddles the control tube 12 and the suspension bar 11;

(5) a hook member 14 from which the suspension wire 13 is suspended;

(6) a ceiling-attached hang line 15 from which the hook member 14 is suspended;

(7) a pitch bar 16 extending between the opposite sides of the hang line 15 a short distance above the hook member 14;

(8) a pitch line 17 attached to the middle of the pitch bar 16 and extending down laterally from it beyond one side of the book;

(9) a hook member 18 attaching the lower end of the pitch line 17 to the suspension bar 11 beyond this side of the book;

and (10) page retainers 19 and 20 extending down from the suspension bar 11 and respectively engaging the open pages of the book (FIG. 2).

The book tie rod 10 is of suitable metal wire, such as piano wire or coat hanger wire about 1/16 inch in diameter and with a total length of about 28 inches. The tie rod is bent into the shape shown in FIG. 3 to provide a straight inner segment 10*a*, about 14 inches long, which will extend along the joined inner edges of the successive pages of a book B where the book is open. At one end the inner segment 10*a* terminates in a U-shaped bight segment 10*b*, and from this bight segment a straight outer segment 10*c* extends almost parallel to the inner segment 10*a*. This outer segment 10*c* will extend along the spine of the book, as shown in FIG. 1, when the book tie rod is applied to the book. At the opposite end from the bight segment 10*b*, the inner segment 10*a* terminates in a hook 10*d* which can be releasably engaged over the free end of the outer segment 10*c* to hold the book clamped snugly between the inner and outer elongated segments 10*a* and 10*c*. These segments are flexible and resilient enough to enable the hook 10*d* to disengage from the outer segment 10*c* after the inner and outer segments are pressed together manually at this end.

Figure 3:
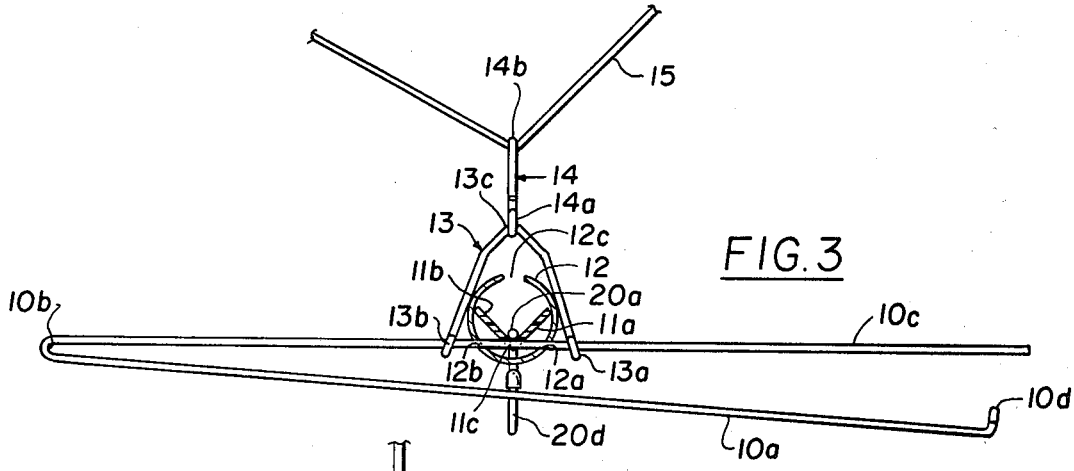
FIG. 3 is a cross-sectional view taken along the line 3—3 in FIG. 1.
Figure 4:
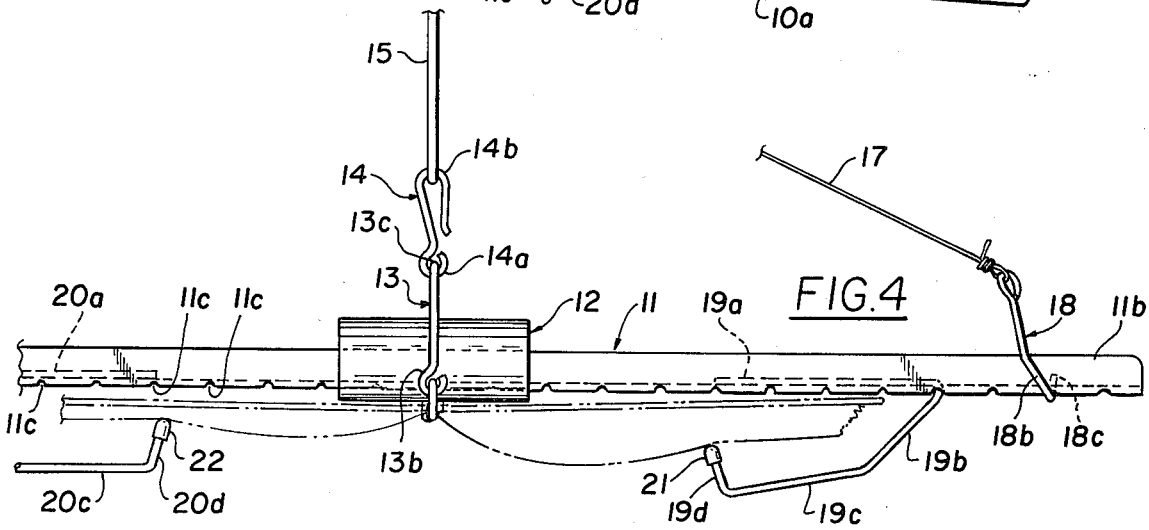
FIG. 4 is a fragmentary rear elevation of the bookholder, viewed from the line 4—4 in FIG. 1.

The suspension angle bar 11 is of V-shaped, right angled cross-section, as shown in FIG. 3, presenting opposite flat legs 11*a* and 11*b* which are joined at their lower edges and diverge upwardly and outwardly from their joined lower edges. At the bottom of the V, the suspension bar is formed with a plurality of circular openings 11*c* at evenly spaced intervals along its length. As shown in FIG. 4, on each side of the suspension bar each of these openings appears as a semi-circular slot which is open at the bottom of the suspension bar. The suspension bar 11 is substantially rigid and it may be of suitable plastic or metal. In one practical embodiment, it is 16 inches long, with a wall thickness of one-sixteenth inch, and the bottom openings are 3/16 inch diameter and positioned at $\frac{3}{4}$ inch intervals along the bar.

The control tube 12 is generally cylindrical, with a longitudinal slot 12*c* along the top which is centered over the suspension bar 11. Preferably, the control tube is of aluminum tubing and it has an inside diameter such that it snugly grips the top edges of the opposite legs 11*a* and 11*b* of the suspension bar 11. Near the bottom on the opposite sides the control tube is formed with a single pair of aligned openings 12*a* and 12*b* (FIG. 3) which are at the same level as the bottom openings 11*c* in the suspension bar 11 when the latter is received in the control tube. The control tube openings 12*a* and 12*b* register with a selected opening 11*c* in the bottom of the suspension bar 11, preferably at the midpoint of the suspension bar. The elongated outer leg 10*c* of the book tie rod 10 extends snugly through these registering openings 12*b*, 11*c* and 12*a* to attach the tie rod to the suspension bar 11.

The suspension wire 13 is of generally inverted V-shape, as shown in FIG. 3, with hooks 13*a* and 13*b* on its lower ends which support the outer leg 10*c* of the book tie rod 10 from below on opposite sides of the control tube 12. The opposite legs of the suspension wire 13 extend upward and inward from these hooks and pass snugly across the outside of the control tube 12 on opposite sides of the latter, as shown in FIG. 3. The suspension wire presents a generally V-shaped bight segment 13*c* at the top which is spaced above and aligned with the central slot 12*c* in the control tube 12. Preferably, the suspension wire 13 is of coathanger wire or piano wire and it is shaped to position its apex about one inch above the outer segment 10*c* of the book tie rod 10.

The hook member 14 presents a hook-shaped segment 14*a* at its lower end which engages from below the bight segment 13*c* at the top of the suspension wire 13 to suspend the latter from above. The hook member 14 also has a hook-shaped segment 14*b* at the top which engages over the lower end of the hang line 15.

The hang line extends down from spaced attachments above to the ceiling or an overhead beam in the room where the present book support is located. The opposite halves 15*a* and 15*b* of the hang line are held apart by the pitch bar 16, which is formed with hook-shaped opposite ends 16*a* and 16*b* that engage the respective halves of the hang line from the inside. Preferably, the hook-shaped ends of the pitch bar grip the hang line snugly. The hang line is of any suitable strong, flexible material. The pitch bar has a downwardly offset loop 16*c* midway along its length. In one practical embodiment the pitch bar is about 13 inches long before being bent to the shape shown. It is constructed of heavy coat-hanger wire 1/16 inch in diameter.

The pitch line 17 is of thin, flexible wire, with its upper end tied to the loop 16*c* at the middle of the pitch bar 16 and its lower end tied to the upper end of the hook member 18. The hook member 18 has a generally V-shaped hook at its lower end, including a downwardly and inwardly inclined outer segment 18*b* which extends snugly against the outside of the wall 11*b* of the suspension bar 11 and a shorter tip 18*c* connected to the lower end of the outer segment 18*b* and extending up into one of the bottom openings 11*c* in the suspension bar 11.

The page retainer 19 at the left side in FIG. 1 has a flat, elongated top segment 19*a* which is seated in the V-shaped recess at the intersection of the opposite walls 11*a* and 11*b* of the suspension bar 11. At the laterally outward end of this top segment 19*a* the page retainer is bent down to provide a downwardly and laterally inwardly inclined segment 19*b*, which extends down through one of the bottom openings 11*c* in the retainer bar 11. A bottom segment 19*c* of the page retainer extends at a very slight downward inclination laterally inward from the lower end of the inclined segment 19*b*. At the opposite end of this bottom segment, an end segment 19*d* extends upward at a slight inclination laterally inward, and it carries a soft rubber or plastic tip 21 on its upper end. Preferably, the page retainer 19 is a 1/16 inch diameter wire of tempered steel or other high tensile strength metal, which has a suitable degree of flexibility and resiliency. In the unstressed condition of the page retainer (i.e., when no book is in place in the book holder) the soft tip 21 will be about ⅛ inch or so directly below the bottom edge of the suspension bar 11. When a book is being inserted in the holder, the page retainer can be flexed manually downward enough to accomodate the thickness of the book on that side. After the book is in place, the resiliency of the page retainer cause it to exert enough upward force to hold the pages on that side of the book up against the cover.

The other page retainer 20 is a mirror image of the just-described page retainer 19 and therefore is not necessary to describe it in detail. Elements of the page retainer 20 which correspond to the elements of page retainer 19 are given the same letter suffix in the drawings. This page retainer 20 carries a soft tip 22 for engaging the open page on that side of the book.

The lateral positions of the page retainers 19 and 20 along the suspension bar will depend, of course, on the page width of the particular book in the holder.

In the assembly of this device, the suspension bar 11 is slidably inserted into the control tube 12 until the bottom opening 11*c* midway along the suspension bar is aligned with the openings 12*a* and 12*b* in the opposite sides of the control tube. The outer elongated segment 10*c* of the book tie rod 10 is slidably inserted through these aligned openings to about the mid-point of the book tie rod. The suspension wire 13 is hooked over the outer segment 10*c* of the book tie rod 10 on opposite sides of the control tube 12 and the suspension bar 11.

With the hook 10*d* on the free end of the inner elongated segment 10*a* of the book tie rod disconnected from the outer segment 10*c*, as shown in FIG. 3, an open book is inserted between the outer and inner segments 10*c* and 10*a*, with the spine of the book next to the outer segment 10*c* of the book tie rod. Preferably, the book is open at the middle, so that substantially the same number of pages are located on opposite sides of the inner segment 10*a* of the book tie rod. The page retainers 19 and 20 are inserted into the openings 10*c* in the suspension bar 11 which are just beyond the respective side edges of the book cover, and the tips 21 and 22 on these page retainers engage the open pages of the book from below.

Following this, the hook 14 is attached to the apex of the suspension wire 13, and this hook is hung over the suspension line 15 so as to position the suspended book just above the reader's head.

Next, the pitch bar 16 is applied to the hang line as shown in FIG. 1, with its hooked ends 16*a* and 16*b* clamped tightly to the line to retain the pitch bar at the desired elevation. The pitch line 17, with its upper end attached to the loop 16*c* at the middle of the pitch bar, is attached by hook 18 to the suspension bar 11 at a selected bottom opening 11*c* at one side of the book. This opening is laterally outward from the opening 11*c* in the suspension bar which receives the page retainer 19 or 20 at that side of the book. This attachment of the pitch line is made at the side of the open book which has the greater number of pages. Preferably, the pitch line is hooked to the suspension bar 11 so as to hold the latter horizontal, and if necessary the length of the pitch line can be shortened or lengthened to adjust this.

The angle of the book from side to side may be adjusted by sliding one end of the pitch bar 16 up along the hang line 15 and the opposite end of the pitch bar down along the hang line.

While reading the book, when the reader wants to turn a page he or she may pull down with the forefinger of one hand on the page retainer and push up on the book with the thumb of the same hand, and slip the page that it to be turned from beneath the tip of the page retainer at that side. The page being turned is slipped under the page retainer at the opposite side in the same fashion.

When what was the lighter side of the book becomes the heavier side, as a result of many pages having been turned, the pitch line 17 should be attached by hook 18 to the suspension bar at the side of the book which is now the heavier side.

To hold the book horizontal, the suspension bar 11 should be adjusted along the tie rod 10 to where it is aligned with the book's center of gravity. If the reader wants to tilt the book (for example, to have the top of the page higher than the bottom), the suspension bar is slidably adjusted along the tie rod in the appropriate direction.

I claim:

1. In an apparatus for holding a book open above a reader, said apparatus comprising:

a suspension bar shaped and dimensioned to extend laterally across the cover of an open book and beyond the opposite side edges of said cover;

means for attaching said suspension bar to an open book to position the suspension bar extending across the cover of the book transverse to the spine of the book and projecting laterally past the opposite side edges of the book cover;

manually yieldable page retainer means operatively coupled to said suspension bar for engagement with the open pages of the book from below to hold the book open;

and suspension means operatively coupled to said suspension bar to suspend it from above;

the improvement wherein said suspension means comprises:

a flexible hang line having interconnected opposite segments attachable respectively at spaced points to an overhead support to position the middle of the hang line closely above said suspension bar;

means for operatively connecting said suspension bar to the middle of the hang line to be suspended from the latter;

a pitch bar extending transversely between and operatively connected to said opposite segments of the hang line above said last-mentioned means;

a pitch line attached at its upper end to said pitch bar between said opposite segments of the hang line and extending down and laterally outward therefrom;

and means attaching the lower end of said pitch line to said suspension bar laterally outward past one side edge of the book cover.

2. In an apparatus for holding a book open above a reader, the combination of:

a suspension bar shaped and dimensioned to extend laterally across the cover of an open book and beyond the opposite side edges of said cover;

means for attaching said suspension bar to an open book to position the suspension bar extending across the cover of the book transverse to the spine of the book and projecting laterally past the opposite side edges of the book cover;

and suspension means operatively coupled to said suspension bar to suspend it from above;

the improvement which comprises:

a pair of manually flexible and resilient page retainer members, each mounted on said suspension bar and extending downward and laterally inward therefrom and terminating at its inner end in an upstanding extremity which is spaced below the suspension bar in the unstressed condition of said page retainer member;

said suspension bar having a plurality of openings on the bottom spaced apart along its length;

and each of said page retainer members being removably received in one of said openings and presenting an elongated top segment which directly overlies the suspension bar and extends laterally inward along the suspension bar from said one opening.

3. An apparatus according to claim 2, wherein said suspension means operatively coupled to said suspension bar comprises a hook removably received in a selected one of said bottom openings in the suspension bar laterally beyond the page retainer member at one side of the book.

4. An apparatus according to claim 1, wherein:

said suspension bar has a plurality of openings on the bottom spaced apart along its length;

and said means attaching the lower end of the pitch line to said suspension bar comprises a hook removably received in a selected one of said bottom openings in the suspension bar.

5. In an apparatus for holding a book open above a reader, said apparatus comprising:

a suspension bar shaped and dimensioned to extend laterally across the cover of an open book and beyond the opposite side edges of said cover;

means for attaching said suspension bar to an open book to position the suspension bar extending across the cover of the book transverse to the spine of the book and projecting laterally past the opposite side edges of the book cover;

manually yieldable page retainer means operatively coupled to said suspension bar for engagement with the open pages of the book from below to hold the book open;

and suspension means operatively coupled to said suspension bar to suspend it from above;

the improvement wherein:

said suspension bar has a bottom opening therein substantially midway along its length;

and said means for attaching the suspension bar to an open book comprises a thin, elongated tie rod having an elongated outer segment adapted to extend along the spine of the book and an elongated inner segment connected at one end to said outer segment and extending generally parallel to the latter, one of said segments having means on its opposite end for releasable engagement with the other of said segments to hold the inner segment toward the outer segment for clamping the book between them along the spine of the book, with the inner segment extending between the open pages of the book, and means for holding said outer segment in said bottom opening in the suspension bar extending substantially perpendicular to the suspension bar.

6. An apparatus according to claim 5, wherein said means for holding is a tube snugly receiving said suspension bar and having openings on opposite sides of the suspension bar which snugly receive said outer segment of the tie rod.

7. An apparatus according to claim 6, and further comprising a suspension wire having hook-shaped opposite ends which engage said outer segment of the tie rod on opposite sides of said tube and said suspension bar, said suspension wire extending up from said outer segment snugly across the opposite sides of said tube.

8. An apparatus according to claim 7, wherein said suspension means comprises:

a flexible hang line having interconnected opposite segments attachable respectively at spaced points to an overhead support to position the middle of the hang line closely above said suspension bar;

means for operatively connecting said suspension bar to the middle of the hang line to be suspended from the latter;

a pitch bar extending transversely between and operatively connected to said opposite segments of the hang line above said last-mentioned means;

a pitch line attached at its upper end to said pitch bar between said opposite segments of the hang line and extending down and laterally outward therefrom;

and means attaching the lower end of said pitch line to said suspension bar laterally outward past one side edge of the book cover.

9. An apparatus according to claim 8, wherein said page retainer means comprises a pair of manually flexible and resilient members, each mounted on said suspension bar and extending downward and laterally inward therefrom and terminating at its inner end in an upstanding extremity which is spaced below the suspension bar in the unstressed condition of said page retainer member.

10. An apparatus according to claim 9, wherein:

said suspension bar has a plurality of openings on the bottom spaced apart along its length;

and each of said page retainer members is removably received in one of said openings and presents an elongated top segment which directly overlies the suspension bar and extends laterally inward along the suspension bar from said one opening.

11. An apparatus according to claim 10, wherein said means attaching the lower end of the pitch line to said suspension bar comprises a hook removably received in a selected one of said bottom openings in the suspension bar laterally beyond the page retainer member at that side.

12. An apparatus according to claim 5, wherein:

said suspension bar has a plurality of additional openings on the bottom spaced apart along its length on opposite sides of said opening which receives said outer segment of the tie rod;

and said page retainer means comprises a pair of manually flexible and resilient members removably received in a pair of said additional openings on opposite sides of the tie rod, each of said page retainer members extending downward and laterally inward from the corresponding opening and terminating at its inner end in an upstanding extremity for engaging an open page of the book.

13. An apparatus according to claim 12, wherein each of said page retainer members has an elongated top segment which directly overlies the suspension bar and extends laterally inward therealong from the opening in the suspension bar which receives said page retainer member.

* * * * *